US012590527B2

(12) United States Patent
Ba et al.

(10) Patent No.: US 12,590,527 B2
(45) Date of Patent: Mar. 31, 2026

(54) ROTARY STEERABLE SYSTEM ADVISOR WITH AUTONOMOUS MODE

(71) Applicant: Schlumberger Technology Corporation, Sugar Land, TX (US)

(72) Inventors: Samba Ba, Houston, TX (US); Juan Carlos Fernandez, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/910,191

(22) Filed: Oct. 9, 2024

(65) Prior Publication Data

US 2025/0129702 A1 Apr. 24, 2025

Related U.S. Application Data

(60) Provisional application No. 63/591,133, filed on Oct. 18, 2023.

(51) Int. Cl.

| | |
|---|---|
| ***E21B 44/00*** | (2006.01) |
| ***E21B 7/06*** | (2006.01) |
| ***E21B 47/024*** | (2006.01) |
| ***E21B 47/04*** | (2012.01) |

(52) U.S. Cl.

CPC ..... *E21B 44/00* (2013.01); *E21B 7/06* (2013.01); *E21B 47/024* (2013.01); *E21B 47/04* (2013.01)

(58) Field of Classification Search

CPC ..... E21B 44/00; E21B 7/06; E21B 47/024; E21B 47/04; E21B 47/12

See application file for complete search history.

(56) References Cited

U.S. PATENT DOCUMENTS

| | | | | |
|---|---|---|---|---|
| 11,396,801 | B2 | 7/2022 | Ba | |
| 11,808,131 | B2 | 11/2023 | Ba | |
| 2016/0024847 | A1 | 1/2016 | Benson | |
| 2022/0290550 | A1 | 9/2022 | Ba | |
| 2022/0333443 | A1 * | 10/2022 | Groover | E21B 4/02 |
| 2024/0035368 | A1 | 2/2024 | Ba | |

FOREIGN PATENT DOCUMENTS

WO WO-2022073027 A1 * 4/2022 ..... E21B 7/04

OTHER PUBLICATIONS

Ba, S. et al., "Expanding Downlink Capabilities Using Autonomous Directional Drilling with Rotary Steerable Systems", ADIPEC, Oct. 31, 2022, 10 Pages.

* cited by examiner

*Primary Examiner* — Dany E Akakpo
(74) *Attorney, Agent, or Firm* — Jeffrey D. Frantz

(57) ABSTRACT

A method for steering a downhole tool to drill a wellbore in a subterranean formation includes receiving an initial wellbore plan for the downhole tool to drill through the subterranean formation. The method also includes receiving drilling data while the downhole tool is drilling through the subterranean formation using the initial wellbore plan. The method also includes comparing the initial wellbore plan to the drilling data. The method also includes determining a downlink command to transmit to the downhole tool based upon or in response to the comparison. The method also includes determining an importance of the downlink command based upon the comparison. The method also includes determining a time to transmit the downlink command to the downhole tool. The time is determined based upon the importance of the downlink command. The method also includes transmitting the downlink command to the downhole tool at the determined time.

20 Claims, 11 Drawing Sheets

| mnemonic | bits | (sec) |
|---|---|---|
| XBOLT.RGR | 9 | 18 |
| POWERDRIVE.IH_TRGT | 12 | 454 |
| XBOLT.RGR | 9 | 22 |
| POWERDRIVE.TASIM_UNC | 12 | 454 |
| XBOLT.RGR | 9 | 22 |
| POWERDRIVE.TSTA2 | 12 | 454 |
| XBOLT.RGR | 9 | 22 |
| POWERDRIVE.TSTA | 12 | 454 |
| XBOLT.RGR | 9 | 22 |
| POWERDRIVE.INCL_CONT | 12 | 454 |
| XBOLT.RGR | 9 | 22 |
| POWERDRIVE.CAZIM_UNC | 12 | 454 |
| XBOLT.RGR | 9 | 22 |
| XBOLT.INCL_CONT | 12 | 454 |
| XBOLT.RGR | 9 | 22 |
| XBOLT.AZIM_CONT_UNC | 13 | 454 |
| XBOLT.RGR | 9 | 22 |
| POWERDRIVE.PD_PRDS | 4 | 454 |
| POWERDRIVE.PROPEFF | 4 | 454 |
| POWERDRIVE.LTRPM | 6 | 454 |
| XBOLT.RGR | 9 | 24 |
| POWERDRIVE.UTRPM | 6 | 454 |
| POWERDRIVE.POSSUM | 7 | 454 |
| XBOLT.RGR | 9 | 22 |
| XBOLT.SHKRSK | 2 | 454 |
| POWERDRIVE.TFDS | 6 | 454 |
| POWERDRIVE.RTF | 6 | 454 |
| XBOLT.RGR | 9 | 24 |
| XBOLT.CRPM | 16 | 454 |
| XBOLT.RGR | 9 | 26 |
| POWERDRIVE.SHKPK_LAT | 6 | 454 |
| POWERDRIVE.TSTA4 | 6 | 454 |
| XBOLT.RGR | 9 | 22 |
| POWERDRIVE.DLNK | 9 | 454 |
| POWERDRIVE.VIB_LAT | 6 | 454 |
| XBOLT.RGR | 9 | 24 |
| POWERDRIVE.VIB_AXL | 5 | 454 |
| XBOLT.SHKPK_LAT | 9 | 454 |
| XBOLT.RGR | 9 | 24 |
| XBOLT.SHKPK_X | 9 | 454 |
| XBOLT.RGR | 9 | 18 |
| XBOLT.VIBLAT_MAX | 9 | 454 |
| XBOLT.RGR | 9 | 18 |
| XBOLT.VIBX_MAX | 9 | 454 |
| XBOLT.RGR | 9 | 18 |
| POWERDRIVE.DlkPage | 3 | 454 |
| POWERDRIVE.TSTA3 | 6 | 454 |
| XBOLT.RGR | 9 | 18 |

FIG. 10

ROTARY STEERABLE SYSTEM ADVISOR WITH AUTONOMOUS MODE

CROSS-REFERENCE TO RELATED APPLICATIONS

This application claims priority to U.S. Provisional Patent Application No. 63/591,133, filed on Oct. 18, 2023, which is incorporated by reference.

BACKGROUND

Directional drilling refers to the intentional deviation of a wellbore from the path it would naturally take. This is accomplished through the use of whipstocks, bottomhole assembly (BHA) configurations, instruments to measure the path of the wellbore in three-dimensional space, data links to communicate measurements taken downhole to the surface, mud motors and special BHA components and drill bits, including a rotary steerable system (RSS), and drill bits.

A rotary steerable system (RSS) is a tool designed to drill directionally with continuous rotation from the surface, eliminating the need to slide a steerable motor. Rotary steerable systems are deployed when drilling directional, horizontal, or extended-reach wells. Some rotary steerable systems have minimal interaction with the borehole, thereby preserving borehole quality. Other rotary steerable systems exert consistent side force similar to stabilizers that rotate with the drillstring or orient the drill bit in the desired direction while continuously rotating at the same number of rotations per minute as the drillstring.

SUMMARY

A method, a non-transitory computer-readable medium, and a computing system for steering a downhole tool to drill a wellbore in a subterranean formation are disclosed. The method includes receiving an initial wellbore plan for the downhole tool to drill through the subterranean formation toward one or more targets. The initial wellbore plan is based at least partially upon a seismic image or model of the subterranean formation. The initial wellbore plan includes a planned direction that the downhole tool is to drill at a plurality of different locations in the subterranean formation; and a planned curvature to be achieved at the plurality of different locations. The method also includes receiving drilling data while the downhole tool is drilling through the subterranean formation using the initial wellbore plan. The drilling data includes a measured direction that the downhole tool is drilling at the plurality of different locations; a measured curvature of the downhole tool at the plurality of locations; a depth of the downhole tool at the plurality of locations; a measured rotations per minute (RPM) of the downhole tool at the plurality of locations; a measured rate of penetration (ROP) of the downhole tool at the plurality of different locations; a measured weight on a drill bit (WOB) of the downhole tool at the plurality of locations; a flow rate of a fluid being pumped into the wellbore when the downhole tool is at the plurality of locations; and a position of a block on a drilling rig at the surface when the downhole tool is at the plurality of locations. The method also includes comparing the initial wellbore plan to the drilling data. The comparison identifies that the downhole tool is approaching an unplanned event that is not accounted for in the initial wellbore plan and the drilling data. The unplanned event includes a previous downlink command not being received by the downhole tool, the drilling data deviating from the initial wellbore plan by more than a predetermined threshold, or both. The drilling data deviating includes the measured curvature differing from than the planned curvature by more than the predetermined threshold. The method also includes determining a downlink command to transmit to the downhole tool. The downlink command is based upon the comparison. The method also includes determining an importance of the downlink command. The importance is based upon the comparison. The method also includes determining a time to transmit the downlink command to the downhole tool. The time is determined based upon the measured ROP and the importance of the downlink command. The method also includes displaying the downlink command to a user. The method also includes providing the user with a predetermined amount of time to accept or reject the downlink command. The predetermined amount of time expires before the determined time to transmit the downlink command to the downhole tool. The method also includes transmitting the downlink command to the downhole tool at the determined time. The downlink command is transmitted by modulating the flow rate or the RPM. The downlink command is transmitted in response to the user accepting the downlink command or not rejecting the downlink command. The downlink command causes the downhole tool to vary the direction that the downhole tool is to drill, the ROP, the WOB, the flow rate, a technique that the downhole tool uses to process measurements that are captured by the downhole tool, or a combination thereof. Varying the technique comprises switching from 3-axis accelerometer measurements and 3-axis magnetometer measurements to single-axis accelerometer measurements to determine an azimuth of the downhole tool.

In another embodiment, the method includes receiving an initial wellbore plan for the downhole tool to drill through the subterranean formation. The method also includes receiving drilling data while the downhole tool is drilling through the subterranean formation using the initial wellbore plan. The method also includes comparing the initial wellbore plan to the drilling data. The method also includes determining a downlink command to transmit to the downhole tool based upon or in response to the comparison. The method also includes determining an importance of the downlink command based upon the comparison. The method also includes determining a time to transmit the downlink command to the downhole tool. The time is determined based upon the importance of the downlink command. The method also includes transmitting the downlink command to the downhole tool at the determined time.

A computing system is also disclosed. The computing system includes one or more processors and a memory system coupled to the one or more processors. The memory system includes one or more non-transitory computer-readable media storing instructions that, when executed by at least one of the one or more processors, cause the computing system to perform operations. The operations include receiving an initial wellbore plan for a downhole tool to drill through a subterranean formation toward one or more targets. The operations also include receiving drilling data while the downhole tool is drilling through the subterranean formation using the initial wellbore plan. The operations also include comparing the initial wellbore plan to the drilling data. The comparison identifies that the downhole tool is approaching an unplanned event that is not accounted for in the initial wellbore plan and/or the drilling data. The operations also include determining a downlink command to transmit to the downhole tool. The downlink command is based upon or in response to the comparison. The operations also include determining an importance of the downlink command based upon the comparison. The operations also include determining a time to transmit the downlink command to the downhole tool. The time is determined based upon the importance of the downlink command. The operations also include transmitting the downlink command to the downhole tool at the determined time.

A non-transitory, computer-readable medium is also disclosed. The medium stores instructions that, when executed by at least one processor of a computing system, cause the computing system to perform operations. The operations include receiving an initial wellbore plan for a downhole tool to drill through a subterranean formation toward one or more targets. The operations also include receiving drilling data while the downhole tool is drilling through the subterranean formation using the initial wellbore plan. The operations also include comparing the initial wellbore plan to the drilling data. The comparison identifies that the downhole tool is approaching an unplanned event that is not accounted for in the initial wellbore plan and/or the drilling data. The unplanned event includes a previous downlink command not being received by the downhole tool, the drilling data deviating from the initial wellbore plan by more than a predetermined threshold, or both. The drilling data deviating comprises the measured curvature differing from the planned curvature by more than the predetermined threshold. The operations also include determining a downlink command to transmit to the downhole tool. The downlink command is based upon or in response to the comparison. The operations also include determining an importance of the downlink command. The importance is based upon the comparison. The operations also include determining a time to transmit the downlink command to the downhole tool. The time is determined based upon the importance of the downlink command and a measured rate of penetration (ROP) of the downhole tool. The operations also include displaying the downlink command to a user. The operations also include providing the user with a predetermined amount of time to accept or reject the downlink command. The operations also include transmitting the downlink command to the downhole tool at the determined time and/or a predetermined depth of the downhole tool.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures:

FIG. 10 illustrates a telemetry frame with dpoints, according to an embodiment.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

Figure 1:
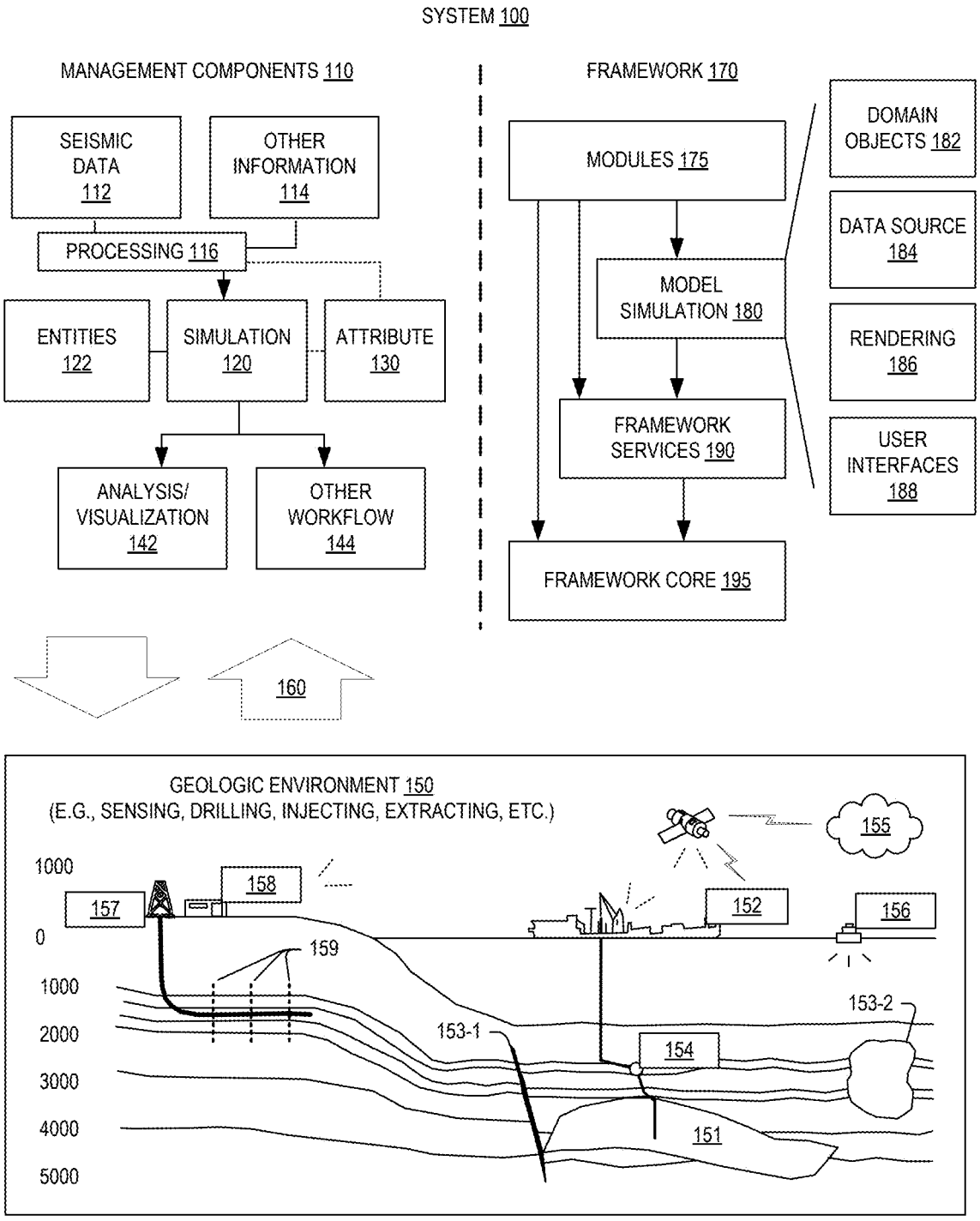
FIG. 1 illustrates an example of a system that includes various management components to manage various aspects of a geologic environment, according to an embodiment.

FIG. 1 illustrates an example of a system 100 that includes various management components 110 to manage various aspects of a geologic environment 150 (e.g., an environment that includes a sedimentary basin, a reservoir 151, one or more faults 153-1, one or more geobodies 153-2, etc.). For example, the management components 110 may allow for direct or indirect management of sensing, drilling, injecting, extracting, etc., with respect to the geologic environment 150. In turn, further information about the geologic environment 150 may become available as feedback 160 (e.g., optionally as input to one or more of the management components 110).

In the example of FIG. 1, the management components 110 include a seismic data component 112, an additional information component 114 (e.g., well/logging data), a processing component 116, a simulation component 120, an attribute component 130, an analysis/visualization component 142 and a workflow component 144. In operation, seismic data and other information provided per the components 112 and 114 may be input to the simulation component 120.

In an example embodiment, the simulation component 120 may rely on entities 122. Entities 122 may include earth entities or geological objects such as wells, surfaces, bodies, reservoirs, etc. In the system 100, the entities 122 can include virtual representations of actual physical entities that are reconstructed for purposes of simulation. The entities 122 may include entities based on data acquired via sensing, observation, etc. (e.g., the seismic data 112 and other information 114). An entity may be characterized by one or more properties (e.g., a geometrical pillar grid entity of an earth model may be characterized by a porosity property). Such properties may represent one or more measurements (e.g., acquired data), calculations, etc.

In an example embodiment, the simulation component 120 may operate in conjunction with a software framework such as an object-based framework. In such a framework, entities may include entities based on pre-defined classes to facilitate modeling and simulation. A commercially available example of an object-based framework is the MICROSOFT®.NET® framework (Redmond, Washington), which provides a set of extensible object classes. In the .NET® framework, an object class encapsulates a module of reusable code and associated data structures. Object classes can be used to instantiate object instances for use in by a program, script, etc. For example, borehole classes may define objects for representing boreholes based on well data.

In the example of FIG. 1, the simulation component 120 may process information to conform to one or more attributes specified by the attribute component 130, which may include a library of attributes. Such processing may occur prior to input to the simulation component 120 (e.g., consider the processing component 116). As an example, the simulation component 120 may perform operations on input information based on one or more attributes specified by the attribute component 130. In an example embodiment, the simulation component 120 may construct one or more models of the geologic environment 150, which may be relied on to simulate behavior of the geologic environment 150 (e.g., responsive to one or more acts, whether natural or artificial). In the example of FIG. 1, the analysis/visualization component 142 may allow for interaction with a model or model-based results (e.g., simulation results, etc.). As an example, output from the simulation component 120 may be input to one or more other workflows, as indicated by a workflow component 144.

As an example, the simulation component 120 may include one or more features of a simulator such as the ECLIPSE™ reservoir simulator (Schlumberger Limited, Houston Texas), the INTERSECT™ reservoir simulator (Schlumberger Limited, Houston Texas), etc. As an example, a simulation component, a simulator, etc. may include features to implement one or more meshless techniques (e.g., to solve one or more equations, etc.). As an example, a reservoir or reservoirs may be simulated with respect to one or more enhanced recovery techniques (e.g., consider a thermal process such as SAGD, etc.).

In an example embodiment, the management components 110 may include features of a commercially available framework such as the PETREL® seismic to simulation software framework (Schlumberger Limited, Houston, Texas). The PETREL® framework provides components that allow for optimization of exploration and development operations. The PETREL® framework includes seismic to simulation software components that can output information for use in increasing reservoir performance, for example, by improving asset team productivity. Through use of such a framework, various professionals (e.g., geophysicists, geologists, and reservoir engineers) can develop collaborative workflows and integrate operations to streamline processes. Such a framework may be considered an application and may be considered a data-driven application (e.g., where data is input for purposes of modeling, simulating, etc.).

In an example embodiment, various aspects of the management components 110 may include add-ons or plug-ins that operate according to specifications of a framework environment. For example, a commercially available framework environment marketed as the OCEAN® framework environment (Schlumberger Limited, Houston, Texas) allows for integration of add-ons (or plug-ins) into a PETREL® framework workflow. The OCEAN® framework environment leverages .NET® tools (Microsoft Corporation, Redmond, Washington) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

FIG. 1 also shows an example of a framework 170 that includes a model simulation layer 180 along with a framework services layer 190, a framework core layer 195 and a modules layer 175. The framework 170 may include the commercially available OCEAN® framework where the model simulation layer 180 is the commercially available PETREL® model-centric software package that hosts OCEAN® framework applications. In an example embodiment, the PETREL® software may be considered a data-driven application. The PETREL® software can include a framework for model building and visualization.

As an example, a framework may include features for implementing one or more mesh generation techniques. For example, a framework may include an input component for receipt of information from interpretation of seismic data, one or more attributes based at least in part on seismic data, log data, image data, etc. Such a framework may include a mesh generation component that processes input information, optionally in conjunction with other information, to generate a mesh.

In the example of FIG. 1, the model simulation layer 180 may provide domain objects 182, act as a data source 184, provide for rendering 186 and provide for various user interfaces 188. Rendering 186 may provide a graphical environment in which applications can display their data while the user interfaces 188 may provide a common look and feel for application user interface components.

As an example, the domain objects 182 can include entity objects, property objects and optionally other objects. Entity objects may be used to geometrically represent wells, surfaces, bodies, reservoirs, etc., while property objects may be used to provide property values as well as data versions and display parameters. For example, an entity object may represent a well where a property object provides log information as well as version information and display information (e.g., to display the well as part of a model).

In the example of FIG. 1, data may be stored in one or more data sources (or data stores, generally physical data storage devices), which may be at the same or different physical sites and accessible via one or more networks. The model simulation layer 180 may be configured to model projects. As such, a particular project may be stored where stored project information may include inputs, models, results and cases. Thus, upon completion of a modeling session, a user may store a project. At a later time, the project can be accessed and restored using the model simulation layer 180, which can recreate instances of the relevant domain objects.

In the example of FIG. 1, the geologic environment 150 may include layers (e.g., stratification) that include a reservoir 151 and one or more other features such as the fault 153-1, the geobody 153-2, etc. As an example, the geologic environment 150 may be outfitted with any of a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or instead include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

As mentioned, the system 100 may be used to perform one or more workflows. A workflow may be a process that includes a number of worksteps. A workstep may operate on data, for example, to create new data, to update existing data, etc. As an example, a may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable in the PETREL® software, for example, that operates on seismic data, seismic attribute(s), etc. As an example, a workflow may be a process implementable in the OCEAN® framework. As an example, a workflow may include one or more worksteps that access a module such as a plug-in (e.g., external executable code, etc.).

Rotary Steerable System (RSS) Advisor with Autonomous Mode

The present disclosure describes a user workflow for operating a directional drilling advisor in autonomous mode for RSS applications. This interaction starts with the user choosing (or choosing not) to enter an autonomous mode also called auto-mode. The present disclosure introduces automation in a new way that engages the directional driller and gets his/her input and involvement to build user trust. The basic workflow can include: identifying scenarios that the automation system can handle with high confidence (i.e., confidence greater than a predetermined confidence threshold). The scenario may be or include a planned event (i.e., part of an initial wellbore plan) or an unplanned event (e.g., not part of the initial wellbore plan). Illustrative unplanned events may include a previous downlink command not being received by the downhole tool, measured drilling data deviating from an initial wellbore plan by more than a predetermined threshold, or both. If it is determined that the scenario event is novel or complex, the advisor continues in advice mode. Novel and/or complex scenarios are scenarios that the automation system is not trained to handle. As used herein, "advice mode" refers to a mode of the automation system where the user provides advice/instructions to the automation system.

If the scenario is known or has been handled in the past with high confidence, automated actions are determined, presented for a driller to review, and executed upon acceptance from the driller (e.g., by not inputting a rejection button within n seconds). When the system is in autonomous mode, the user can still interact with it and provide inputs that may be used by the system to provide better calculations and actions to be taken going forward.

The autonomous mode is a journey. In other words, the directional drilling advisor may be placed in autonomous mode gradually as it matures and obtains enough trust and engagement from the user. One of the challenges with automation is getting the user to trust the system and manage this relationship between the two. For the next phase of the directional drilling advisor, automation may be introduced in a way that engages the directional driller and gets his/her input and involvement. An example workflow of this is provided below.

1. Identify scenarios that the automation system can handle with confidence above a predetermined confidence threshold (e.g., 75%).
2. If the scenario is novel and/or complex, continue in advice mode.
3. If the scenario is known and/or has been handled in the past with confidence and/or success above the confidence threshold:
   a. Determine a set of automated actions to take.
   b. Display the automated actions for the directional driller for review.

c. Send a notification that, after a timer is complete (e.g., 3 minutes), the system executes the automated action.
d. Provide the user with an opportunity to reject the automated action.
e. If the automated action is accepted and/or no explicit rejection is made, then take the automated actions.

4. When the system is in autonomous mode, the user can still interact with it and provide inputs. These inputs allow the system to provide better calculations and actions to be taken. For example, if the user anticipates some upcoming changes in the steering tendency, the user can update the RSS yield and then ask the system to recompute a set of actions without exiting the auto-mode.

Figure 2:
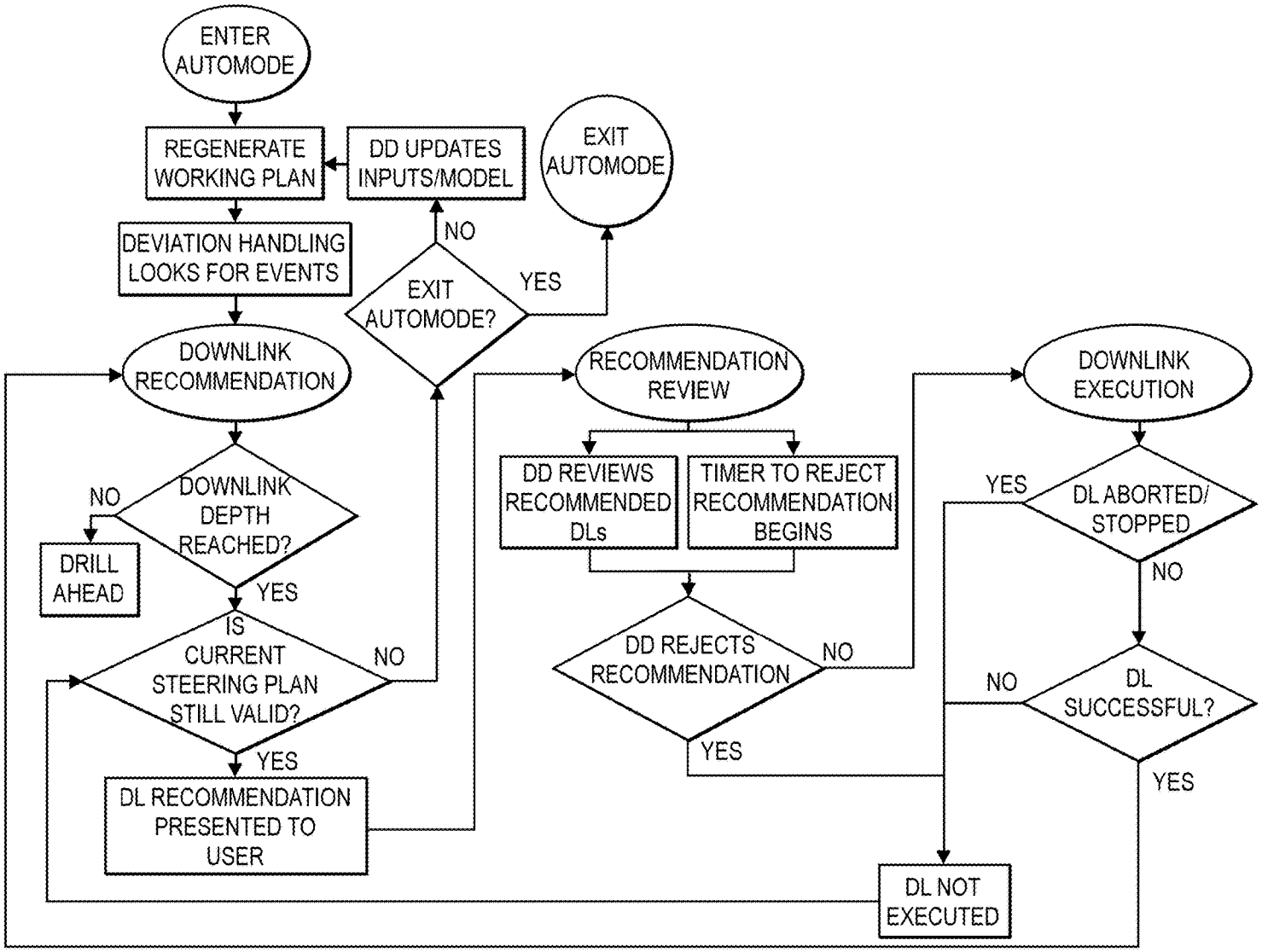
FIG. 2 illustrates a flowchart of a method for generating a downlink (DL) recommendation in auto-mode, according to an embodiment.

FIG. 2 illustrates a flowchart of a method for generating a downlink (DL) recommendation in auto-mode, according to an embodiment. More particularly, FIG. 2 describes in more detail an example of steering setting automation where the system autonomously sends downlink commands to the RSS tool in the wellbore. There are multiple (e.g., three) portions of the process. The first portion (e.g., downlink recommendation) uses the current steering setting of the tool along with targets and a working plan to determine what command to send. It then uses a rate of penetration (ROP) of the RSS tool to predict when to send the downlink so that it is completed at the correct depth.

In the second portion (e.g., recommendation review), the user reviews and decides whether to intervene by rejecting the downlink, or let it continue sending the downlink command for execution. Finally in the third portion (e.g., downlink execution), the downlink may be monitored, and a confidence level may be assigned to determine success using surface and/or downhole confirmation. If the downlink is confirmed to be successful, the system proceeds to handle the next downlink command in line. If the downlink is not successful, the system checks whether the steering plan still remains valid via a deviation handler. At this point, the system provides the user with the option to exit auto-mode or remain in auto-mode and provide inputs for the system to create a new steering plan and/or working plan.

As mentioned above, upon entering the auto-mode, the system may trigger a high alert deviation handling (DH). This deviation handling may carefully monitor the state of the system to make sure that there are no major deviations that would lead to a change of actions and/or transitioning back the control from the autonomous system to the user.

Figure 3:
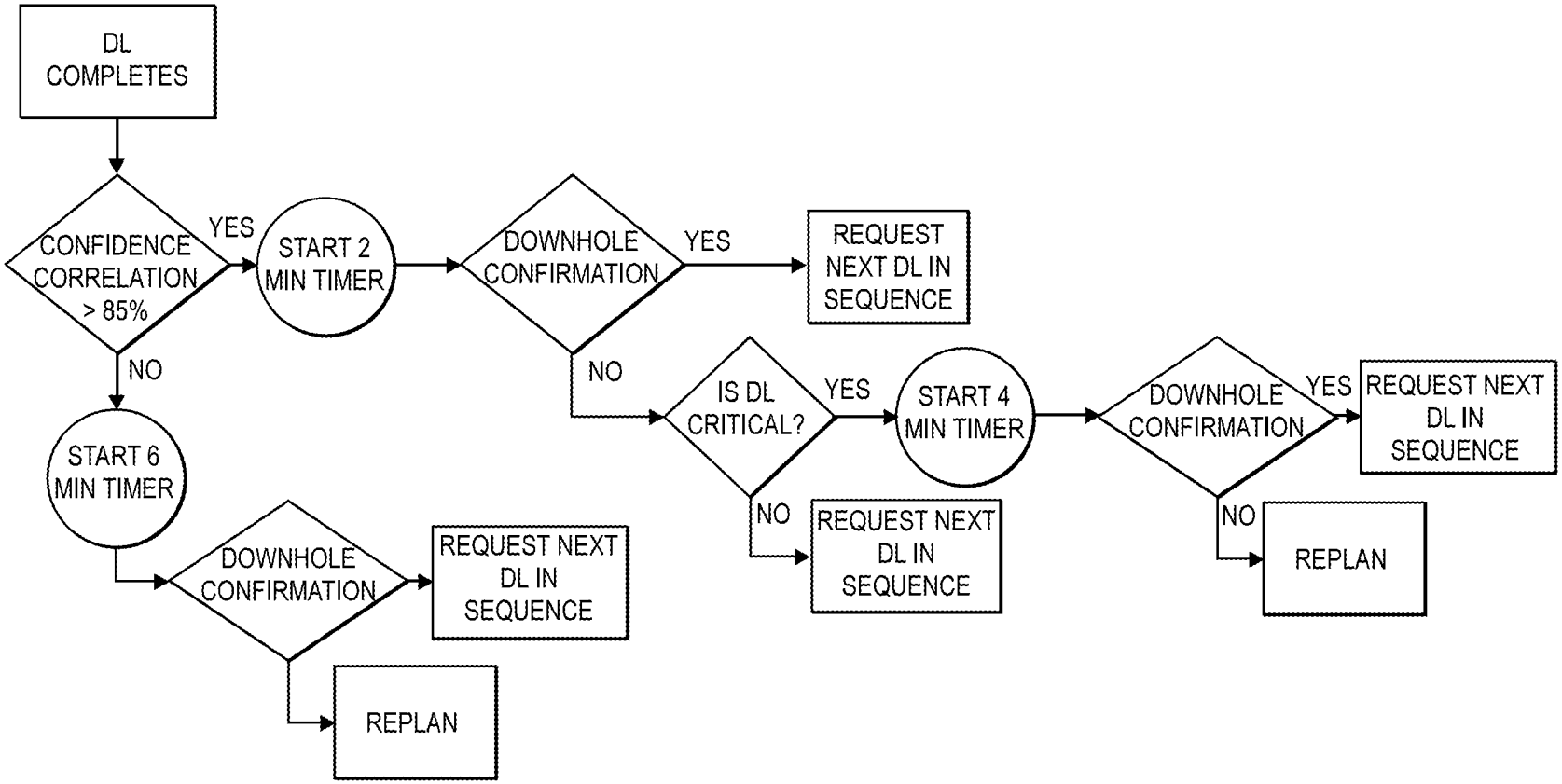
FIG. 3 illustrates a flowchart of a method for generating a DL time delay, according to an embodiment.
Figure 4:
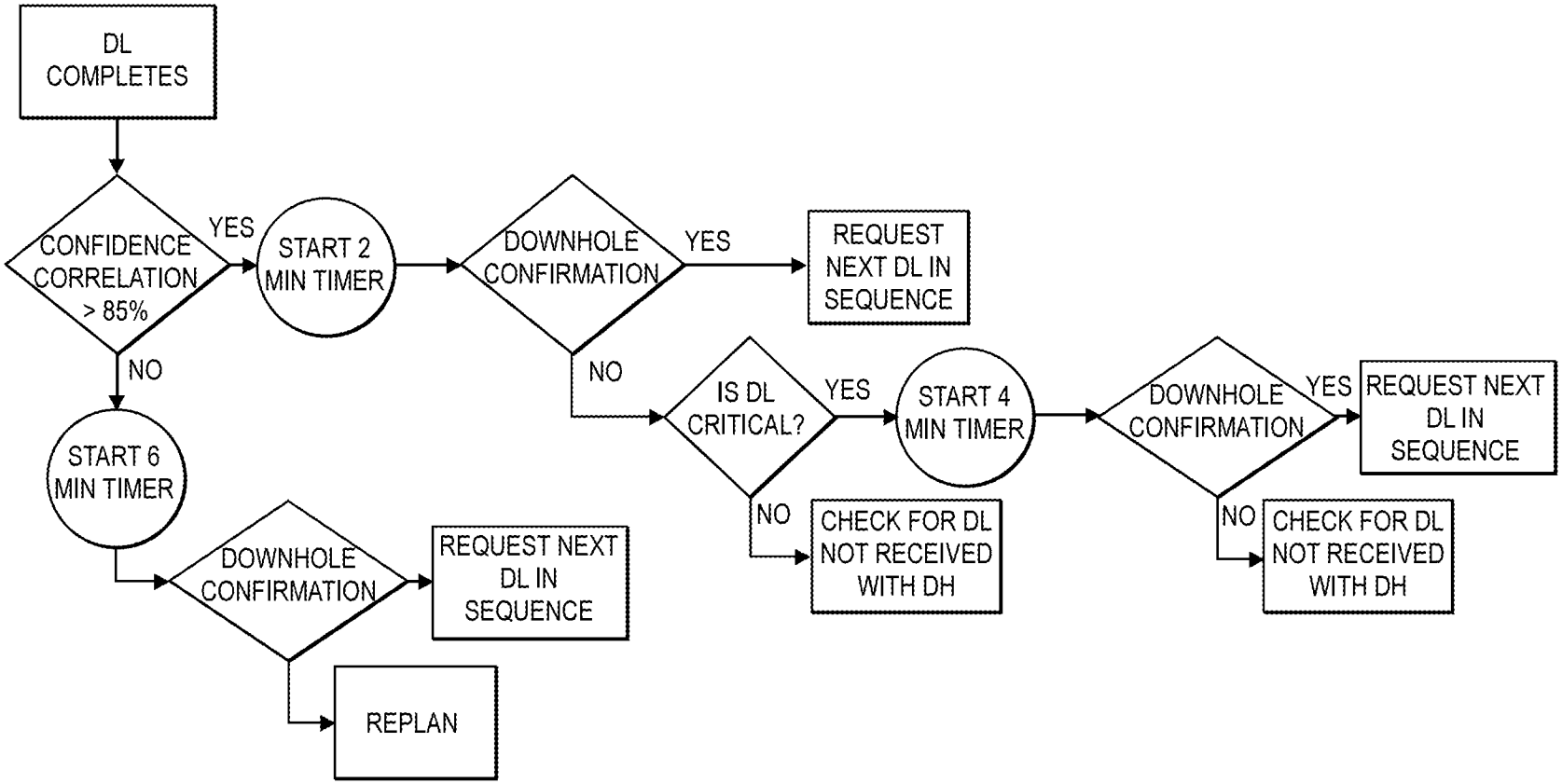
FIG. 4 illustrates another flowchart of a method for generating a DL time delay, according to an embodiment.

FIGS. 3 and 4 illustrate flowcharts of a method for generating a DL time delay, according to an embodiment. The method may derive proper timing between consecutive downlinks. After the first downlink is completed, the system analyzes the confidence level of that downlink. When the confidence level exceeds a predetermined value, a minimum timer may be started to allow for the downhole tool to send confirmation of receipt of the downlink. If no confirmation is received, based on the uplink telemetry timing, the system may evaluate whether the downlink is critical or not. If the downlink is critical, the next downlink is automatically requested. If the downlink is not critical, the timing may be evaluated based on the uplink telemetry timing and a replan may be triggered to eventually resend the same downlink or an alternative one based on the updated location of the trajectory with respect to the original plan.

Figure 5:
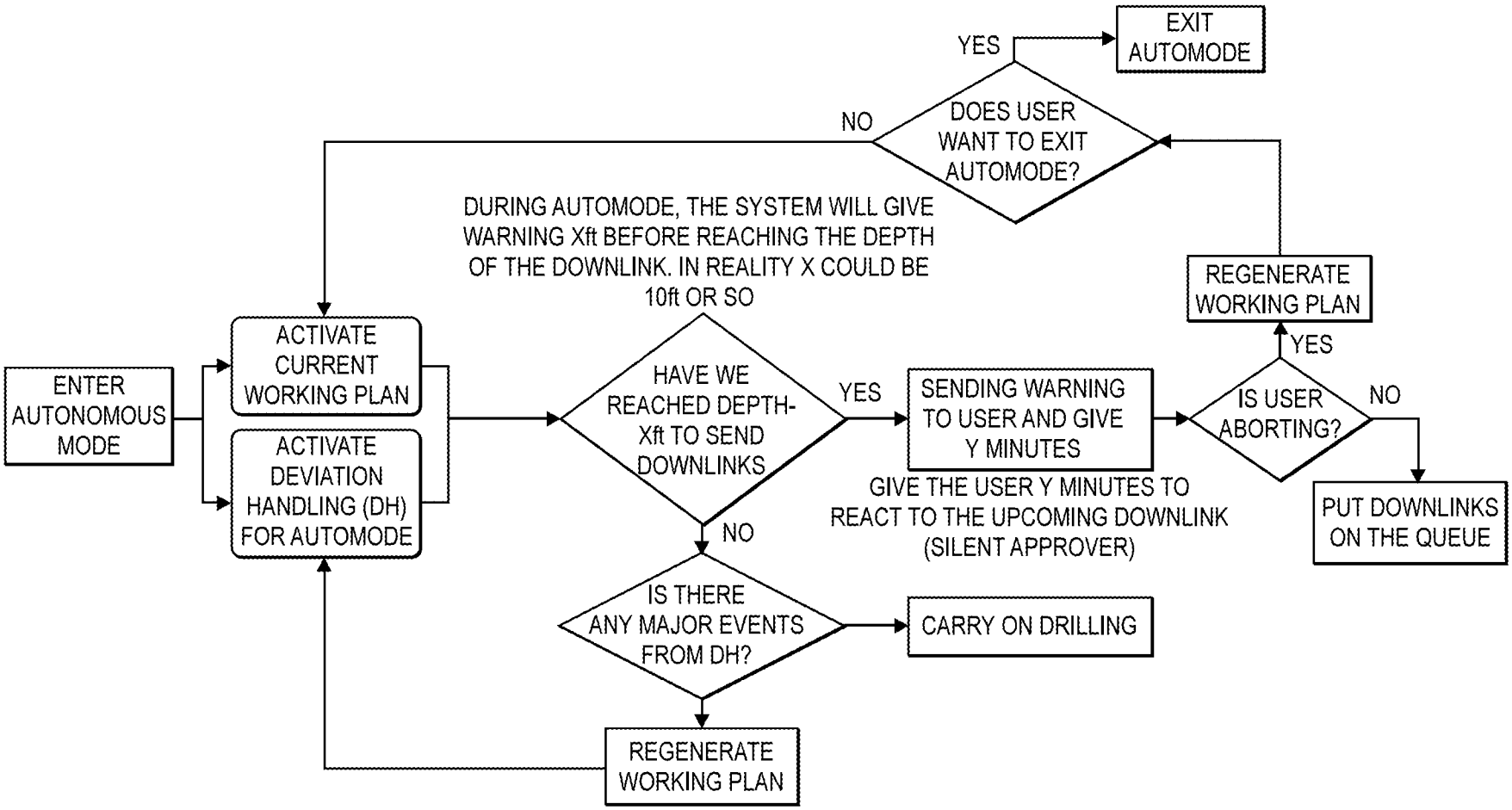
FIG. 5 illustrates a flowchart of a method for interacting with the system (e.g., a directional drilling advisor) in the auto-mode, according to an embodiment.

FIG. 5 illustrates a flowchart of a method for interacting with the system (e.g., directional drilling advisor) in the auto-mode, according to an embodiment. The method may anticipate when the RSS tool is getting close to the depth (e.g., within 10 m or less) at which the downlink should be executed. For example, a warning Y may depend upon the ROP, the operational conditions (e.g., on bottom and/or off bottom), anticipated changes on drilling parameters like flow rate, rotations per minute (RPM), weight-on-bit (WOB), or a combination thereof.

Figure 6:
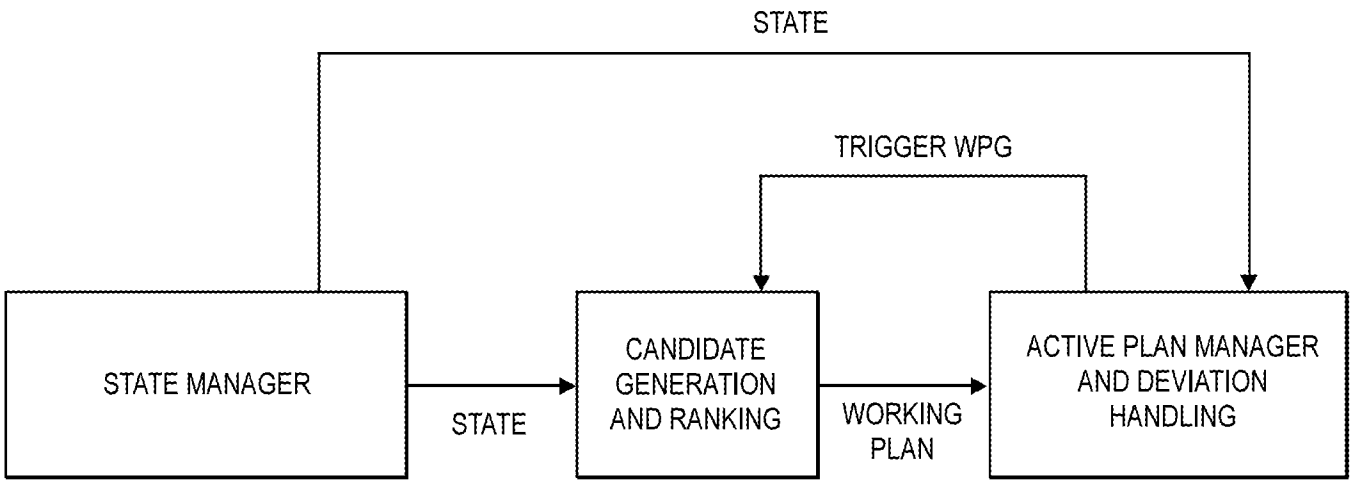
FIG. 6 illustrates a schematic view of a deviation handler module, according to an embodiment.

FIG. 6 illustrates a schematic view of a deviation handler module, according to an embodiment. The deviation handler module may be in charge of automatically monitoring and reacting to important deviations from what is expected from the system. When a deviation is detected, the deviation handler may trigger an alarm or warning to the user. In some cases, the deviation handler can intervene and trigger an automatic working plan generation to modify (e.g., rectify) the current course. A new working plan may be generated after each survey. The deviation handler may monitor the current state of the system and trigger the emergency generation of a new working plan to respond to unwanted deviations.

Figure 7:
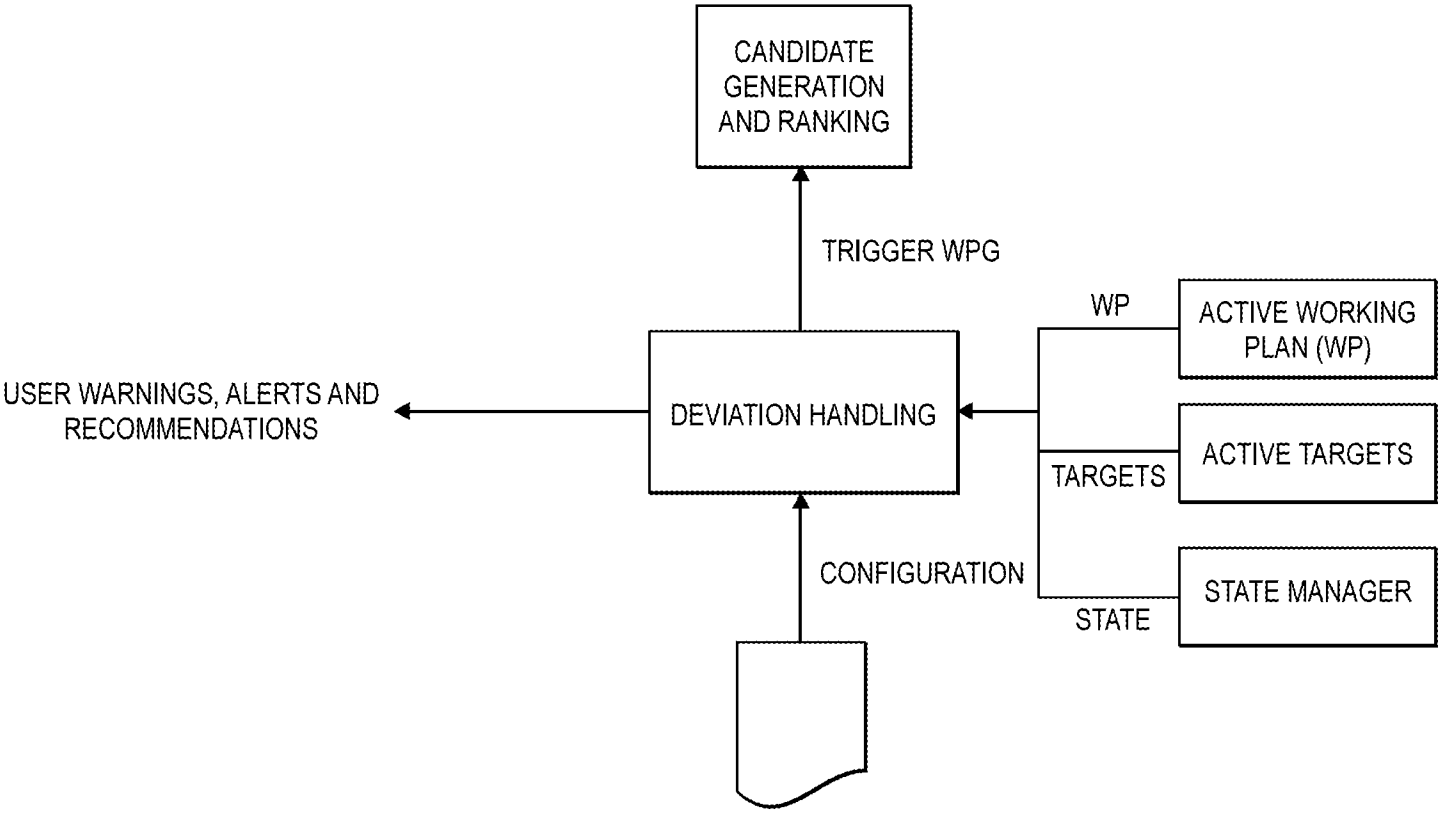
FIG. 7 illustrates another schematic view of the deviation handler module, according to an embodiment.
Figure 8:
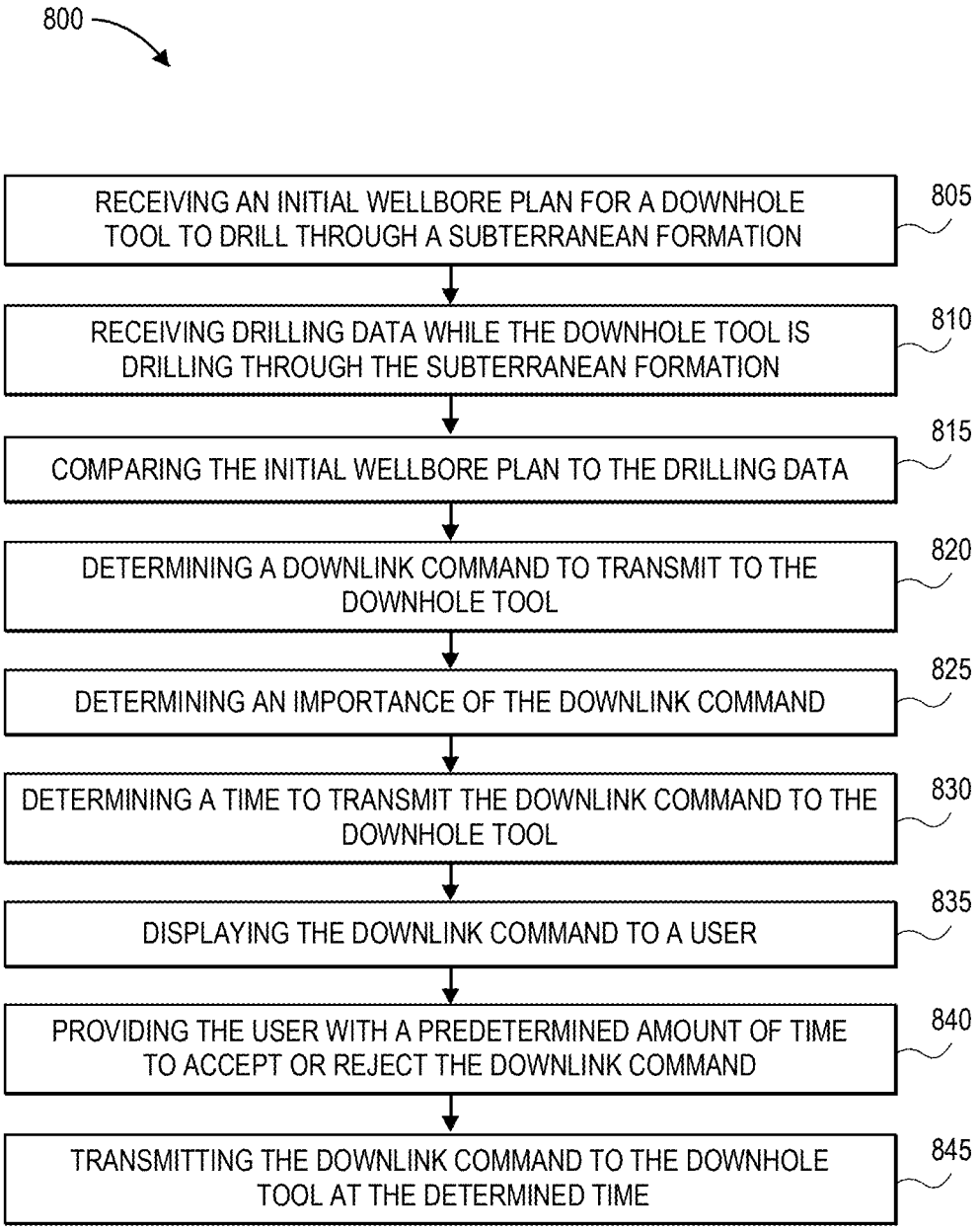
FIG. 8 illustrates a flowchart of a method for steering a downhole tool to drill a wellbore in a subterranean formation, according to an embodiment.

FIG. 7 illustrates another schematic view of the deviation handler module, according to an embodiment. From the state estimation, a number of deviations can be monitored such as RT Yield discrepancies
downlink sent but not received (e.g., confirmation of successful downlinks at surface and/or downhole
dynamic light scattering (DLS) Saturation
cD&I trajectory excessive deviation from the plan in terms of 3D position but also attitudes (e.g., inclination and azimuth)
toolface offset deviation
tool malfunction and/or tool health
Poor SEF
drilling parameters adjustment FIG. 8 illustrates a flowchart of a method 800 for steering a downhole tool to drill a wellbore in a subterranean formation, according to an embodiment. At least a portion of the method 800 may be performed by the directional drilling advisor and/or the deviation handler module (e.g., in auto-mode). An illustrative order of the method 800 is provided below; however, one or more portions of the method 800 may be performed in a different order, simultaneously, repeated, or omitted.

The method 800 may include receiving an initial wellbore plan for a downhole tool, as at 805. The initial wellbore plan may be for the downhole tool to drill through the subterranean formation toward one or more targets (e.g., a hydrocarbon reservoir). The initial wellbore plan may be based at least partially upon a seismic image and/or a model of the subterranean formation. The initial wellbore plan may include a planned direction that the downhole tool is to drill at a plurality of different locations in the subterranean formation. For example, this may include a first planned direction at a first location, a second planned direction at a second location, etc. The initial wellbore plan may also or instead include a planned curvature to be achieved at the plurality of different locations. For example, this may include a first curvature at a first location, a second curvature at a second location, etc. The downhole tool may be or include a BHA, RSS, a drill bit, etc.

The method 800 may also include receiving drilling data while the downhole tool is drilling through the subterranean formation using the initial wellbore plan, as at 810. The drilling data may include downhole measurements that are measured by (e.g., sensors on/in) the downhole tool. The drilling data may also include surface measurements. The drilling data may include a measured direction that the downhole tool is drilling at the plurality of different locations, a measured curvature of the downhole tool at the plurality of locations, a measured depth of the downhole tool at the plurality of locations, a measured rotations per minute (RPM) of the downhole tool at the plurality of locations, a measured rate of penetration (ROP) of the downhole tool at the plurality of different locations, a measured weight on a drill bit (WOB) of the downhole tool at the plurality of locations, a measured flow rate of a fluid being pumped into the wellbore when the downhole tool is at the plurality of locations, a measured position of a block on a drilling rig at the surface when the downhole tool is at the plurality of locations, settings of the downhole tool when the downhole tool is at the plurality of locations, or a combination thereof. The settings may include a steering mode (e.g., manual, HIA, IH, auto-curve) of the downhole tool, an orientation of a tool face of the downhole tool, a steering ratio of the downhole tool, a steering efficiency factor of the downhole tool, or a combination thereof.

The method 800 may also include comparing the initial wellbore plan to the drilling data, as at 815. The comparison may identify that the downhole tool has encountered and/or is approaching an unplanned event that is not accounted for in the initial wellbore plan and/or the drilling data. The unplanned event may be or include a previous downlink command not being received by the downhole tool, the drilling data deviating from the initial wellbore plan by more than a predetermined threshold, an object in the path of the downhole tool, or combination thereof. The drilling data deviating may include the measured curvature differing from the planned curvature by more than the predetermined threshold.

The method 800 may also include determining a downlink command to transmit to the downhole tool, as at 820. The downlink command may be based upon or in response to the comparison. For example, the comparison may show that the desired tool face may be different than the actual tool face being used by the downhole tool, and in response, the downlink command may include instructions to actuate to the desired tool face. In another example, the comparison may show that the current steering ratio is different from the desired steering ratio, and in response, the downlink command may include instructions to actuate to correct the steering ratio to the desired value.

The method 800 may also include determining an importance of the downlink command, as at 825. The importance may be based upon the comparison. For example, the comparison may show that a new steering mode should be downlinked to the downhole tool, and in response, the importance may be determined to be a first (e.g., critical) level. In another example, the comparison may show just a small difference (e.g., less than a predetermined threshold) between a current steering parameter and the desired steering parameter, and in response, the importance may be determined to be a second (e.g., low) level.

The method 800 may also include determining a time (e.g., 5 minutes from now) to transmit the downlink command to the downhole tool, as at 830. The time may be determined based upon the measured ROP, the importance of the downlink command, and/or the uplink telemetry timing. For example, in response to the measured ROP being low and the importance being low, the time may be high/long. In another example, in response to the measured ROP being high and the importance being critical, the time may be low/short, as it may be paramount to send the downlink quickly in order to avoid too much trajectory deviation from the original.

Figure 9:
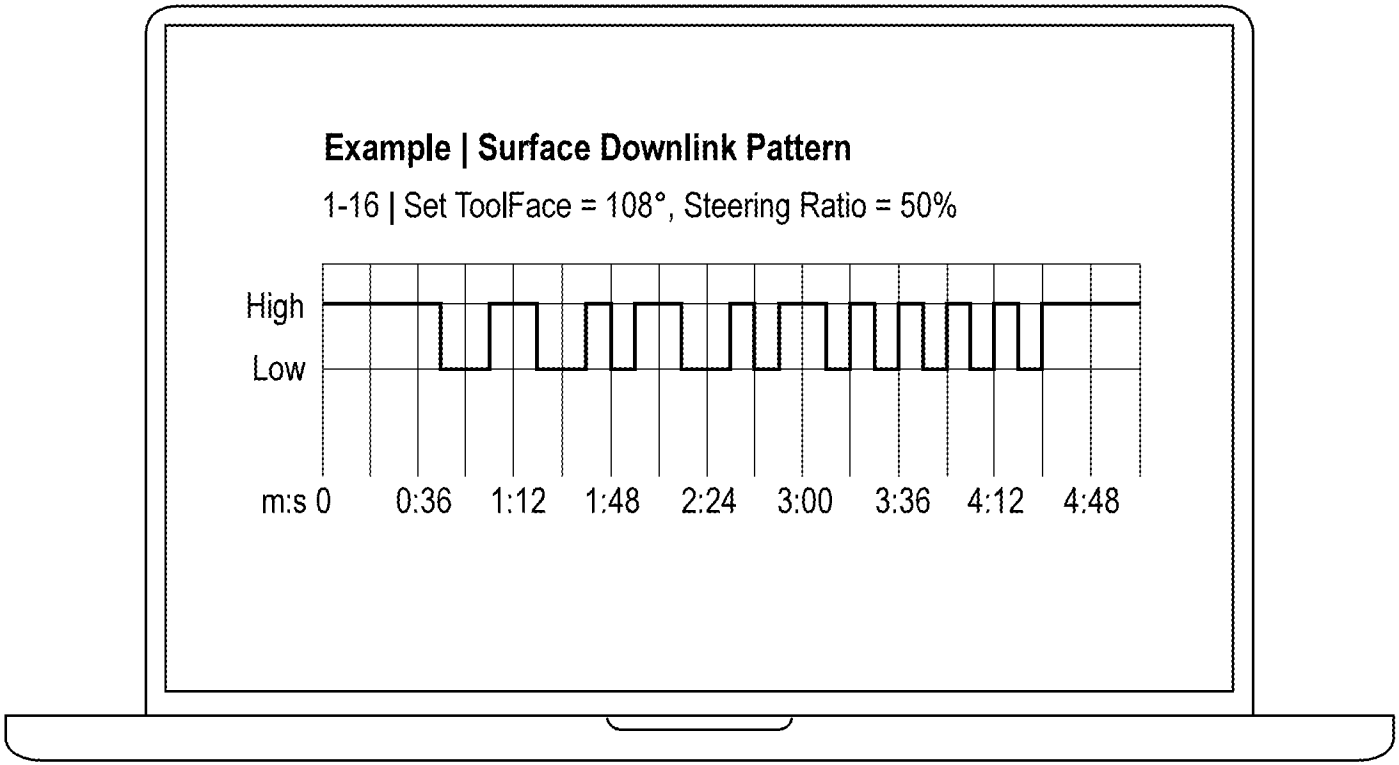
FIG. 9 illustrates a view of a downlink command (e.g., including highs and lows) that may be displayed to the user, according to an embodiment.

The method 800 may also include displaying the downlink command to a user, as at 835. This may include showing sequence of high and lows to follow so that the downhole tool will recognize the pattern. FIG. 9 illustrates a view of a downlink command (e.g., including highs and lows) that may be displayed to the user, according to an embodiment.

The method 800 may also include providing the user with a predetermined amount of time (e.g., 30 seconds-3 minutes) to accept or reject the downlink command, as at 840. The predetermined amount of time may be less than (and/or expire before) the determined time to transmit the downlink command to the downhole tool. The predetermined amount of time may be based upon a time that an uplink command from the downhole tool is received at the surface and/or a frequency of data points in the downhole data (e.g., in the uplink command). For example, the (e.g., maximum) waiting time may be determined using the following formula:

$$t_{Max} = \max_{t} (t_{MWD} + t_{HOP}, 2t_{MWD})$$

where $t_{MWD}$ is the time difference between two consecutive RSS dpoints sent by the downhole (e.g., MWD) tool based on the telemetry frame, and $t_{HOP}$ is the time difference between two consecutive RSS dpoints sent to the MWD tool by the HOP tool. As used herein, "dpoints" (also known as "downhole points") are downhole data points that are measured/captured by the downhole tool (e.g., MWD, RSS, etc.) and transmitted up to (e.g., a computing system at) the surface. The dpoints are transmitted to the surface in a telemetry frame. The communication between some RSS tools and the MWD tool (that is sending the dpoints uphole) may not be direct. The HOP tool collects the data from the RSS tool and sends the data to the MWD tool when the MWD tool requests this data to be part of the telemetry frame. FIG. 10 illustrates a telemetry frame with dpoints, according to an embodiment.

The method 800 may also include transmitting the downlink command to the downhole tool at the determined time, as at 845. The downlink command may also or instead be transmitted at a determined depth of the downhole tool. The downlink command may be transmitted by modulating the flow rate into the wellbore and/or downhole tool. The downlink command may also or instead be transmitted by modulating the RPM of the downhole tool. The downlink command may be transmitted in response to the user accepting the downlink command or not rejecting the downlink command. The downlink command may cause the downhole tool to vary the direction that the downhole tool is to drill at a predetermined depth and/or location, vary the curvature of the downhole tool at a predetermined depth and/or location, the ROP at a predetermined depth and/or location, the WOB at a predetermined depth and/or location, the flow rate at a predetermined depth and/or location, a technique that the downhole tool uses to process measurements that are captured by the downhole tool, or a combination thereof. In an example, varying the technique may include switching from 3-axis accelerometer measurements and 3-axis magnetometer measurements to single-axis accelerometer measurements to determine an azimuth of the downhole tool.

Figure 11:
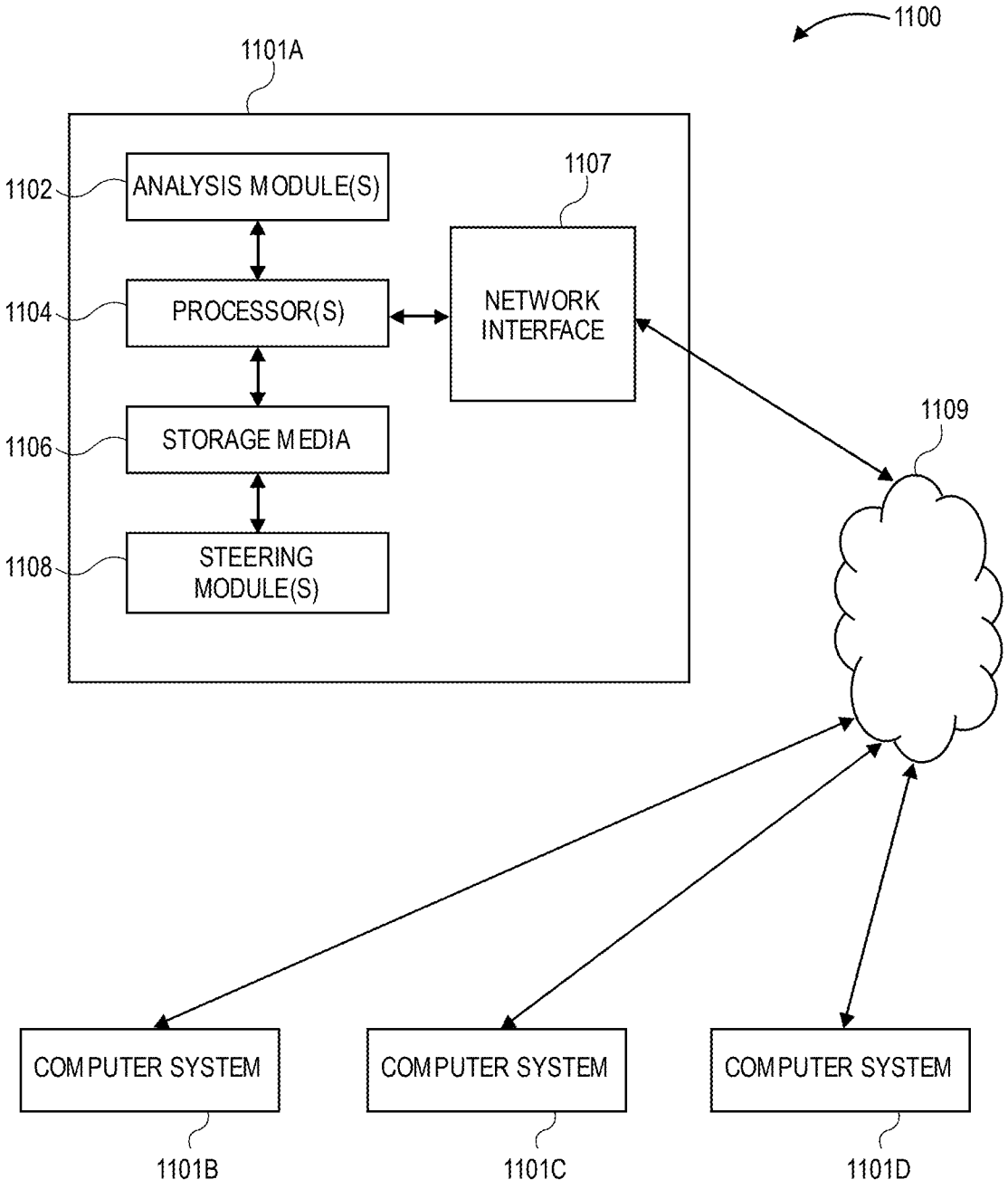
FIG. 11 illustrates a computing system for performing at least a portion of the method(s) disclosed herein, according to an embodiment.

In some embodiments, any of the methods of the present disclosure may be executed by a computing system. FIG. 11 illustrates an example of such a computing system 1100, in accordance with some embodiments. The computing system 1100 may include a computer or computer system 1101A, which may be an individual computer system 1101A or an arrangement of distributed computer systems. The computer system 1101A includes one or more analysis module(s) 1102 configured to perform various tasks according to some embodiments, such as one or more methods disclosed herein. To perform these various tasks, the analysis module 1102 executes independently, or in coordination with, one or more processors 1104, which is (or are) connected to one or more storage media 1106. The processor(s) 1104 is (or are) also connected to a network interface 1107 to allow the computer system 1101A to communicate over a data network 1109 with one or more additional computer systems and/or computing systems, such as 1101B, 1101C, and/or 1101D (note that computer systems 1101B, 1101C and/or 1101D may or may not share the same architecture as computer system 1101A, and may be located in different physical locations, e.g., computer systems 1101A and 1101B may be located in a processing facility, while in communication with one or more computer systems such as 1101C and/or 1101D that are located in one or more data centers, and/or located in varying countries on different continents).

A processor can include a microprocessor, microcontroller, processor module or subsystem, programmable integrated circuit, programmable gate array, or another control or computing device.

The storage media 1106 can be implemented as one or more computer-readable or machine-readable storage media. Note that while in the example embodiment of FIG. 6 storage media 1106 is depicted as within computer system 1101A, in some embodiments, storage media 1106 may be distributed within and/or across multiple internal and/or external enclosures of computing system 1101A and/or additional computing systems. Storage media 1106 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

In some embodiments, computing system 1100 contains one or more steering module(s) 1108 that may perform at least a portion of one or more of the method(s) described above. It should be appreciated that computing system 1100 is only one example of a computing system, and that computing system 1100 may have more or fewer components than shown, may combine additional components not depicted in the example embodiment of FIG. 11, and/or computing system 1100 may have a different configuration or arrangement of the components depicted in FIG. 11. The various components shown in FIG. 11 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

Geologic interpretations, models and/or other interpretation aids may be refined in an iterative fashion; this concept is applicable to embodiments of the present methods discussed herein. This can include use of feedback loops executed on an algorithmic basis, such as at a computing device (e.g., computing system 1100, FIG. 11), and/or through manual control by a user who may make determinations regarding whether a given step, action, template, model, or set of curves has become sufficiently accurate for the evaluation of the subterranean three-dimensional geologic formation under consideration.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be re-arranged, and/or two or more elements may occur simultaneously. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A method for steering a downhole tool to drill a wellbore in a subterranean formation, the method comprising:

receiving an initial wellbore plan for the downhole tool to drill through the subterranean formation;

receiving drilling data while the downhole tool is drilling through the subterranean formation using the initial wellbore plan;

comparing the initial wellbore plan to the drilling data;

determining a downlink command to transmit to the downhole tool, wherein the downlink command is based upon or in response to the comparison;

determining an importance of the downlink command based upon the comparison;

determining a time to transmit the downlink command to the downhole tool, wherein the time is determined based upon the importance of the downlink command; and transmitting the downlink command to the downhole tool at the determined time.

2. The method of claim 1, wherein the initial wellbore plan comprises:

a planned direction that the downhole tool is to drill at a plurality of different locations in the subterranean formation; and a planned curvature of the downhole tool to be achieved at the plurality of different locations.

3. The method of claim 2, wherein the drilling data comprises:

a measured direction that the downhole tool is drilling at the plurality of different locations in the subterranean formation;

a measured curvature of the downhole tool at the plurality of different locations;

a measured depth of the downhole tool at the plurality of different locations;

a measured number of rotations per minute (RPM) of the downhole tool at the plurality of locations;

a measured rate of penetration (ROP) of the downhole tool at the plurality of different locations;

a measured weight on a drill bit (WOB) of the downhole tool at the plurality of locations;

a measured flow rate of a fluid being pumped into the wellbore when the downhole tool is at the plurality of different locations;

a measured position of a block on a drilling rig at a surface when the downhole tool is at the plurality of different locations;

settings of the downhole tool when the downhole tool is at the plurality of different locations, wherein the settings comprise a steering mode of the downhole tool, an orientation of a tool face of the downhole tool, a steering ratio of the downhole tool, a steering efficiency factor of the downhole tool, or a combination thereof; or a combination thereof.

4. The method of claim 3, wherein the comparison identifies that the downhole tool has encountered or is approaching an unplanned event that is not accounted for in the initial wellbore plan and/or the drilling data, wherein the unplanned event comprises a previous downlink command not being received by the downhole tool, the drilling data deviating from the initial wellbore plan by more than a predetermined threshold, or both, and wherein the drilling data deviating comprises the measured curvature differing from the planned curvature by more than the predetermined threshold.

5. The method of claim 1, wherein the time to transmit the downlink command is also based upon a measured rate of penetration (ROP) of the downhole tool.

6. The method of claim 1, further comprising displaying the downlink command to a user.

7. The method of claim 1, further comprising providing a user with a predetermined amount of time to accept or reject the downlink command, wherein the predetermined amount of time is based upon a time that an uplink command from the downhole tool is received at a surface and/or a frequency of data points in the drilling data.

8. The method of claim 7, wherein the predetermined amount of time expires before the determined time to transmit the downlink command to the downhole tool.

9. The method of claim 7, wherein the downlink command is transmitted by modulating a flow rate of a fluid being pumped into the downhole tool or a number of rotations per minute (RPM) of the downhole tool, and wherein the downlink command is transmitted in response to the user accepting the downlink command or not rejecting the downlink command.

10. The method of claim 1, wherein the downlink command causes the downhole tool to vary a direction that the downhole tool is drilling, a curvature of the downhole tool, a rate of penetration (ROP) of the downhole tool, a weight-on-bit (WOB) of the downhole tool, a flow rate of a fluid flowing through the downhole tool, or a combination thereof.

11. A computing system, comprising:

one or more processors; and a memory system coupled to the one or more processors and comprising one or more non-transitory computer-readable media storing instructions that, when executed by at least one of the one or more processors, cause the computing system to perform operations, the operations comprising:

receiving an initial wellbore plan for a downhole tool to drill through a subterranean formation toward one or more targets;

receiving drilling data while the downhole tool is drilling through the subterranean formation using the initial wellbore plan;

comparing the initial wellbore plan to the drilling data, wherein the comparison identifies that the downhole tool is approaching an unplanned event that is not accounted for in the initial wellbore plan and/or the drilling data;

determining a downlink command to transmit to the downhole tool, wherein the downlink command is based upon or in response to the comparison;

determining an importance of the downlink command based upon the comparison;

determining a time to transmit the downlink command to the downhole tool, wherein the time is determined based upon the importance of the downlink command; and transmitting the downlink command to the downhole tool at the determined time.

12. The computing system of claim 11, wherein the unplanned event comprises the drilling data deviating from the initial wellbore plan by more than a predetermined threshold, and wherein the drilling data deviating comprises a measured curvature differing from a planned curvature by more than the predetermined threshold.

13. The computing system of claim 11, wherein the operations further comprise providing a user with a predetermined amount of time to accept or reject the downlink command.

14. The computing system of claim 13, wherein the predetermined amount of time is based upon a time that an uplink command from the downhole tool is received at a surface and/or a frequency of data points in the drilling data, and wherein the predetermined amount of time expires before the determined time to transmit the downlink command to the downhole tool.

15. The computing system of claim 11, wherein the downlink command is transmitted by modulating a flow rate of fluid flowing through the downhole tool or a number of rotations per minute (RPM) of the downhole tool, wherein the downlink command is transmitted in response to a user accepting the downlink command or not rejecting the downlink command, wherein the downlink command causes the downhole tool to vary a technique that the downhole tool uses to process measurements that are captured by the downhole tool, wherein varying the technique comprises switching from 3-axis accelerometer measurements and 3-axis magnetometer measurements to single-axis accelerometer measurements to determine an azimuth of the downhole tool.

16. A non-transitory, computer-readable medium storing instructions that, when executed by at least one processor of a computing system, cause the computing system to perform operations, the operations comprising:

receiving an initial wellbore plan for a downhole tool to drill through a subterranean formation toward one or more targets;

receiving drilling data while the downhole tool is drilling through the subterranean formation using the initial wellbore plan;

comparing the initial wellbore plan to the drilling data, wherein the comparison identifies that the downhole tool is approaching an unplanned event that is not accounted for in the initial wellbore plan and/or the drilling data, wherein the unplanned event comprises a previous downlink command not being received by the downhole tool, the drilling data deviating from the initial wellbore plan by more than a predetermined threshold, or both, and wherein the drilling data deviating comprises a measured curvature differing from a planned curvature by more than the predetermined threshold;

determining a downlink command to transmit to the downhole tool, wherein the downlink command is based upon or in response to the comparison;

determining an importance of the downlink command, wherein the importance is based upon the comparison;

determining a time to transmit the downlink command to the downhole tool, wherein the time is determined based upon the importance of the downlink command and a measured rate of penetration (ROP) of the downhole tool;

displaying the downlink command to a user;

providing the user with a predetermined amount of time to accept or reject the downlink command; and transmitting the downlink command to the downhole tool at the determined time.

17. The non-transitory, computer-readable medium of claim 16, wherein the initial wellbore plan is based at least partially upon a seismic image or a model of the subterranean formation, and wherein the initial wellbore plan comprises:

a planned direction that the downhole tool is to drill at a plurality of different locations in the subterranean formation; and a planned curvature of the downhole tool to be achieved at the plurality of different locations.

18. The non-transitory, computer-readable medium of claim 17, wherein the drilling data comprises:

a measured direction that the downhole tool is drilling at the plurality of different locations;

a measured curvature of the downhole tool at the plurality of locations;

a measured depth of the downhole tool at the plurality of locations;

a measured rotations per minute (RPM) of the downhole tool at the plurality of locations;

a measured rate of penetration (ROP) of the downhole tool at the plurality of different locations;

a measured weight on a drill bit (WOB) of the downhole tool at the plurality of locations;

a measured flow rate of a fluid being pumped into a wellbore of the initial wellbore plan when the downhole tool is at the plurality of locations;

a measured position of a block on a drilling rig at a surface when the downhole tool is at the plurality of locations; and settings of the downhole tool when the downhole tool is at the plurality of locations, wherein the settings comprise a steering mode of the downhole tool, an orientation of a tool face of the downhole tool, a steering ratio of the downhole tool, and a steering efficiency factor of the downhole tool.

19. The non-transitory, computer-readable medium of claim 18, wherein the predetermined amount of time is based upon a time that an uplink command from the downhole tool is received at the surface and a frequency of data points in the drilling data, and wherein the predetermined amount of time expires before the determined time to transmit the downlink command to the downhole tool.

20. The non-transitory, computer-readable medium of claim 19, wherein the downlink command is transmitted by modulating the flow rate or the RPM, wherein the downlink command is transmitted in response to the user accepting the downlink command or not rejecting the downlink command, wherein the downlink command causes the downhole tool to vary the direction that the downhole tool is to drill, the curvature of the downhole tool, the ROP, the WOB, the flow rate, and a technique that the downhole tool uses to process measurements that are captured by the downhole tool, wherein varying the technique comprises switching from 3-axis accelerometer measurements and 3-axis magnetometer measurements to single-axis accelerometer measurements to determine an azimuth of the downhole tool.

* * * * *